US006557297B2

(12) United States Patent
Receveur

(10) Patent No.: US 6,557,297 B2
(45) Date of Patent: May 6, 2003

(54) ADJUSTABLE WATER PLANT CONTAINER SUPPORT ASSEMBLY

(76) Inventor: Richard L. Receveur, 10108 Fairmount Rd., Louisville, KY (US) 40291

( * ) Notice: Subject to any disclaimer, the term of this patent is extended or adjusted under 35 U.S.C. 154(b) by 14 days.

(21) Appl. No.: 09/768,901

(22) Filed: Jan. 25, 2001

(65) Prior Publication Data

US 2002/0095863 A1 Jul. 25, 2002

(51) Int. Cl.[7] ..... A47C 7/00; A01G 9/00
(52) U.S. Cl. ..... 47/39; 47/65.5
(58) Field of Search ..... 47/39, 29.5; 135/16; 248/519; D24/130; 285/335; 411/371.1

(56) References Cited

U.S. PATENT DOCUMENTS

| | | | | | |
|---|---|---|---|---|---|
| 1,609,246 | A | * | 11/1926 | Hamburger | 47/39 |
| 2,003,986 | A | * | 6/1935 | Witthuhn | 47/39 |
| 3,830,013 | A | | 8/1974 | Lesley | |
| 4,038,779 | A | | 8/1977 | Roberts, Jr. et al. | |
| 4,041,641 | A | | 8/1977 | Dietz | |
| D259,870 | S | | 7/1981 | Marantette | |
| 4,591,126 | A | * | 5/1986 | Berney | 248/524 |
| 4,596,262 | A | * | 6/1986 | Tegze | 135/21 |
| 5,312,601 | A | | 5/1994 | Patrick | |
| 6,014,838 | A | | 1/2000 | Asher | |
| 6,029,937 | A | * | 2/2000 | Funaro | 248/146 |

FOREIGN PATENT DOCUMENTS

| | | | | |
|---|---|---|---|---|
| GB | 2204785 | * | 11/1988 | 47/39 |

* cited by examiner

*Primary Examiner*—Charles T. Jordan
*Assistant Examiner*—Susan C. Alimenti
(74) *Attorney, Agent, or Firm*—Maurice L. Miller, Jr.

(57) ABSTRACT

A height adjustable support assembly for a receptacle in which a water plant or other vegetation can be grown is disclosed. The assembly includes a base which can be weighted down with granulated material such as sand or pebbles, a two section, telescopically adjustable, elongated supporting column attached on a lower end to the base, and a receptacle attached to an upper end of the supporting column. In one embodiment, the receptacle is fitted with a flotation collar so that it can float on the surface of the water containment means in which the assembly is disposed as the water surface level changes, carrying with it an upper section of the supporting column. In another embodiment, the height of the supporting column and receptacle can be incrementally adjusted and fixed by means of a retaining pin. In yet another embodiment the supporting column height can be adjusted and fixed by means of a threaded cap containing a compressible gasket. Means for stabilizing the alignment of the upper section with a lower section of the supporting column is also disclosed.

8 Claims, 3 Drawing Sheets

ADJUSTABLE WATER PLANT CONTAINER SUPPORT ASSEMBLY

BACKGROUND OF THE INVENTION

This invention relates to an assembly which can be disposed in a water pond, pool, tank, stream or other water containment means, which includes a weighted base, a telescopically adjustable column extending vertically from the base and a receptacle affixed to an upper end of the column in which water plants or other vegetation can be hydroponically grown. The receptacle can be arranged to float on the surface of the water so that it and an upper section of the column can rise and fall with variations in the water level. In the alternative, the height of the receptacle above the base can be adjusted and fixed.

Broadly speaking, the use of floatable pots or receptacles for water plants and other vegetation is old and well known in the prior art. See, for example, U.S. Pat. No. 6,014,838 granted to C. M. Asher on Jan. 18, 2000; U.S. Pat. No. 4,041,641 granted to A. L. Dietz on Aug. 16, 1977 and U.S. Pat. No. 2,686,389 granted to C. B. Rozell on Aug. 17, 1954. Such floating receptacles typically are in the form of a flower pot containing a surrounding flotation collar. A problem which can be encountered in the use of such prior art floating receptacles is that they tend to drift about within the confines of the body of water in which they are disposed. This is desirable in the Dietz patent wherein he purposely moves floating pots containing plants in a circular path around a cylindrically shaped water tank under a light source. But in many cases such movement would be a disadvantage. The Asher patent deals with the problem of drift by suspending a weighted object in the nature of a ballast or anchor below a floating plant receptacle by means of lines. Presumably the anchor lies upon the bottom of the water pool in which the receptacle floats. But unless the anchor is sufficiently massive in comparison with the pot from which it is suspended, the latter may continue drifting movement by dragging the anchor. Certainly, if the lines are loose, as they will be from time to time provided the weight rests fully on the bottom of the pool, a certain amount of drifting will occur even if the anchor holds its position.

I have determined that it would be desirable to provide an assembly for a floatable receptacle which rests upon the bottom of a pool of water and confines the floatable receptacle to a fixed position of the water surface. The assembly should permit the receptacle to float up and down on the water surface as its level changes. In the alternative, as in cases where the water level does not change, the assembly should provide for setting the receptacle at one of several different heights so that such a fixed arrangement can be used in different pools or tanks wherein the depth varies.

By means of my invention, these and other difficulties encountered in the prior art are substantially overcome.

SUMMARY OF THE INVENTION

It is an object of my invention to provide an assembly for a water plant receptacle wherein the receptacle can float on the surface of a water pond, pool, stream, tank or the like to take advantage of changes in water level but cannot drift from a fixed position.

It is a further object of my invention to provide an assembly for supporting a water plant receptacle, which receptacle can be fixedly adjusted in height above a base of the assembly for use in different water containment means having different depths.

Briefly, in accordance with my invention, there is provided an adjustable water plant container assembly. The assembly includes a weightable base for stable disposition on the floor of a water containment means and a telescopically height adjustable vertically extending column attached on a lower end thereof to the base. The assembly also includes a water plant receptacle fixedly attached to an upper end of the supporting column.

These and other objects, features and advantages of the present invention will become apparent to those skilled in the art from the following detailed description and attached drawings upon which, by way of example, only a preferred and certain important alternative embodiments of my invention are described and shown.

DESCRIPTION OF THE PREFERRED EMBODIMENT

Figure 2:
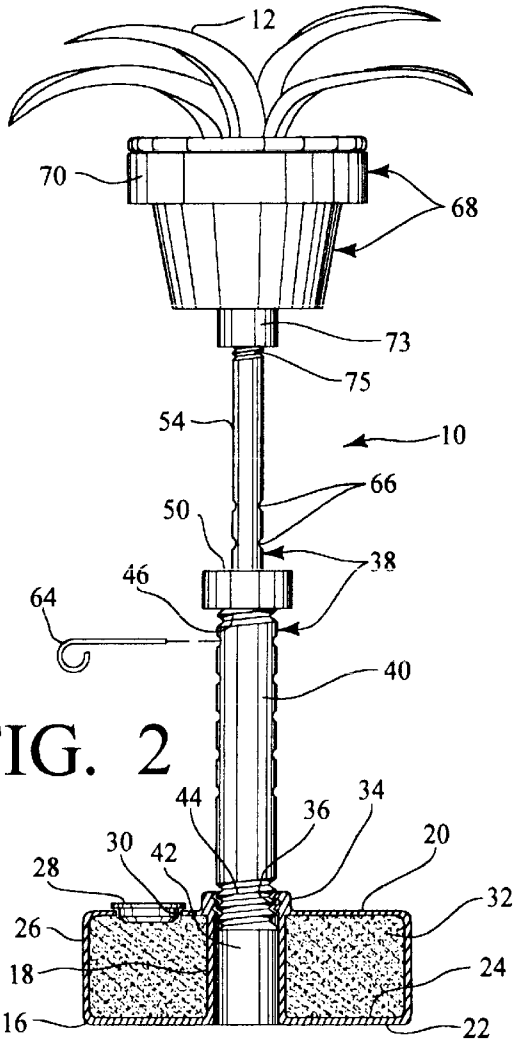
FIG. 2 shows an elevation view of the assembly of FIG. 1 with a water plant added to the receptacle.
Figure 5:
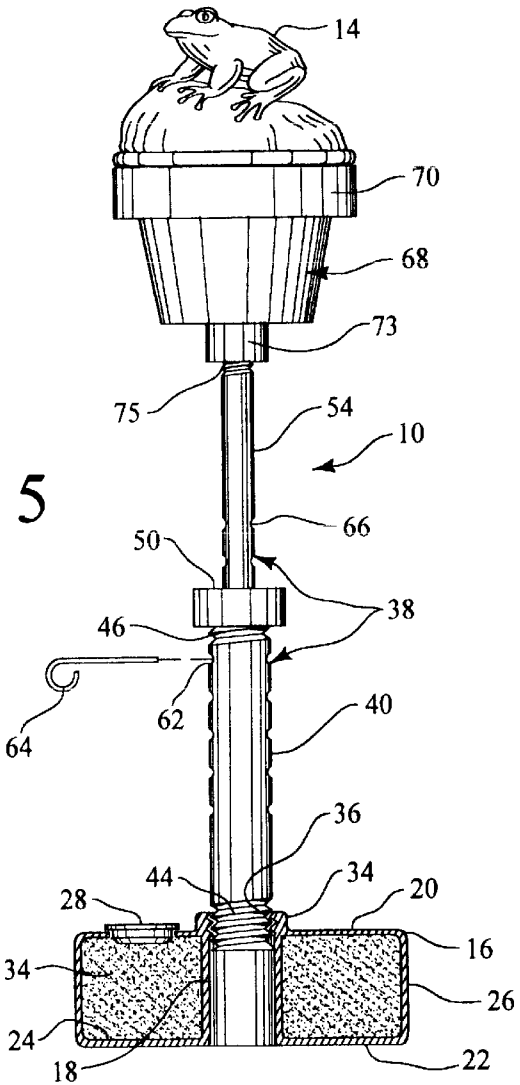
FIG. 5 shows a side elevation view of the assembly of FIGS. 1–3, the same as viewed in FIG. 2 but with an artistic figurine mounted in the receptacle in place of the water plant.

Referring now to the drawing figures and, in particular, to FIGS. 1–3 and 5, there is shown, in a preferred embodiment of my invention, a water plant container assembly, generally designated 10, for use in a water pool, pond, stream, tank or the like to hold a water plant, such as at 12 in FIG. 2, or an artistic figurine, such as at 14 in FIG. 5. The assembly 10 includes a cylindrically shaped base 16 having a hollow, cylindrically shaped central shaft 18 extending between circular openings on upper and lower surfaces 20 and 22, respectively. The base 16 also includes a hollow, annularly shaped interior chamber 24 (See FIGS. 2 and 5) defined by an outer surface of the central shaft 18 and by the upper and lower surfaces 20, 22 and a vertical outer wall 26 of the base. A disc shaped cap 28 is removably friction fitted into an off-center circular opening 30 (FIG. 2) formed in the upper surface 20 for providing access to the chamber 24. The chamber 24 can be filled with a suitable granulated material such as sand 32 prior to use to permit the base to be sinkable in water and to provide a stable foundation for the assembly 10 in a water filled pool, pond, stream or tank. The base 16 is preferably constructed of a flexible, resilient, shape retentive material such as rubber or plastic. Finally, the base 16 includes a cylindrically shaped collar 34 on the upper surface 20 which extends around the upper opening of the shaft 18, which collar contains interior threading 36 (See FIG. 5).

Figure 3:
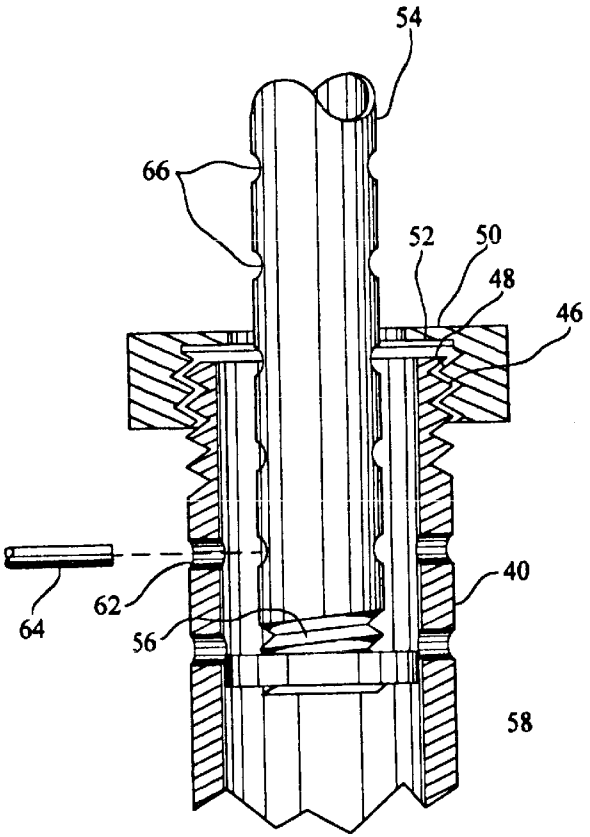
FIG. 3 shows a cross sectional view of a fragment of the assembly of FIGS. 1–2.

The assembly 10 further includes an elongate, cylindrically shaped, telescopically adjustable, column generally designated 38. A first hollow, cylindrically shaped pipe 40 of the column 38 contains an unthreaded base portion 42 which is removably inserted into the shaft 18 in a friction fitting or otherwise closely conforming manner below the collar 34 and the interior threading 36 of the latter. Just above the base portion 42 is a portion 44 which is exteriorly threaded in conformity with the interior threading 36 of the collar 34 so that the threadings 36 and 44 engage when a lower end of the first pipe 40 is inserted in the shaft 18 to a level near the shaft opening on the lower surface 22 of the base 16. By then turning the first pipe 40 in the proper direction, the lower end of the pipe 40 should be approximately flush with the lower surface 22 of the base 16 when the threads 36 and 44 are fully engaged. An upper end portion 46 of the first pipe 40 is exteriorly threaded so as to engage conforming interior threads 48 of a cap 50 as shown in FIG. 3. An upper surface of the cap 50 defines a circular central opening 52 therein which permits a second hollow cylindrically shaped pipe 54, having an outside diameter less than the inside diameter of the first pipe 40, to be inserted relatively closely through the opening 52. The second pipe 54 fits relatively less closely inside the first pipe 40. Accordingly, a lower end portion of the second pipe 54 is exteriorly threaded, as at 56 in FIG.3, so that a confinement ring 58 can be threaded thereon. The ring 58 should fit relatively closely, yet slidably, around an interior wall 60 (See FIG. 3) of the first pipe 40. The ring 58, operating between the lower end portion of the second pipe 54 and the surrounding interior wall 60 of the first pipe 40, in combination with the closely spaced opening 52 of the cap 50 relative to an upwardly spaced apart portion of the second pipe 54, aides in stabilizing alignment of the second pipe 54 with the first pipe 40. The ring 58 also prevents removal of the second pipe 54 from the upper end of the first pipe 40 when the cap 50 is operatively positioned as shown. At least one hole 62 (See FIG. 3) may be formed, preferably in an upper end portion of the first pipe 40 just below the threads 46 by a distance sufficient to provide clearance with the cap 50, for permitting a pin 64 to be inserted through the wall of the first pipe into a selected one of several vertically spaced apart and aligned holes 66 formed in a lower end portion of the second pipe 54, which are located above the threading 56 and ring 58. In this manner, the second pipe 54 can be fixed at one of several desired levels of extension above the cap 50 and upper end of the first pipe 40, as desired.

Figure 1:
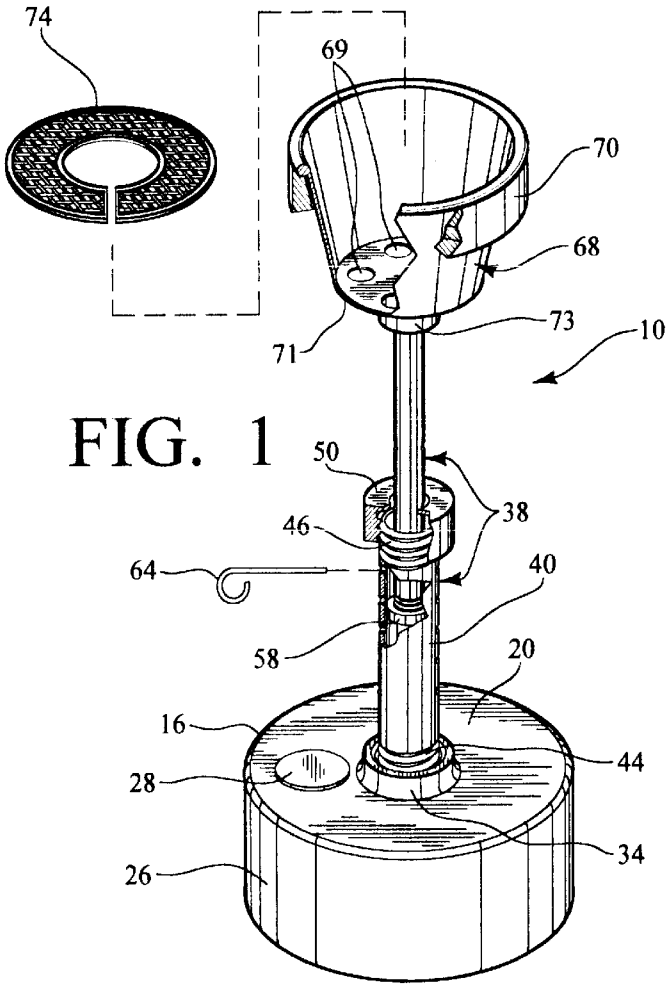
FIG. 1 shows a perspective view of an assembly for a floatable water plant receptacle for use in a pond, pool, stream or tank, thus illustrating a preferred embodiment of my invention.

The assembly 10 also includes a water plant or figurine receptacle, generally designated 68 which, in the present example, is in the shape of a truncated cone open on its upper end and contains a series of holes 69 in a bottom plate 71 thereof to allow water to enter. An annularly shaped flotation collar 70 made of a suitable compressible, resilient plastic foam, rubber or other buoyant material can be friction fitted around an upper end portion of the receptacle 68, to permit the receptacle 68 to float on the surface of a water pool, pond, stream or tank in circumstances where the water level tends to change as a result of the weather conditions, seasonal changes or the like. The receptacle 68 includes an interiorally threaded collar 73 integrally attached to and projecting downwardly from a central portion of the plate 71. The collar 73 threads onto conforming exterior threads 75 located on an upper end portion of the second pipe 54 so that the second pipe 54 is carried up and down within the first pipe 40 as the receptacle 68 and flotation collar 70 ride upon the surface of the changing water levels in a pool, pond, stream, tank or the like. For this reason, the ring 58 should, while being closely spaced apart from the interior wall 60 of the first pipe 40, not be tight fitting against that wall. Such a close spaced but slidable arrangement between the ring 58 and the interior wall 60 will permit the float collar 70 to carry both the receptacle 68, containing either a water flower such as at 12 in FIG. 2, or a FIG. 14 such as in FIG. 5, and the second pipe 54 and the ring 58 as water levels change in the pool, stream, pond or tank without use of the pin 64. An annularly shaped net 74 as shown in FIG. 1, can be placed in the receptacle 68, over and around the flowers 12 (FIG. 2) to keep fish and other aquatic animals from eating or otherwise disturbing the roots or base of the plants.

Figure 4:
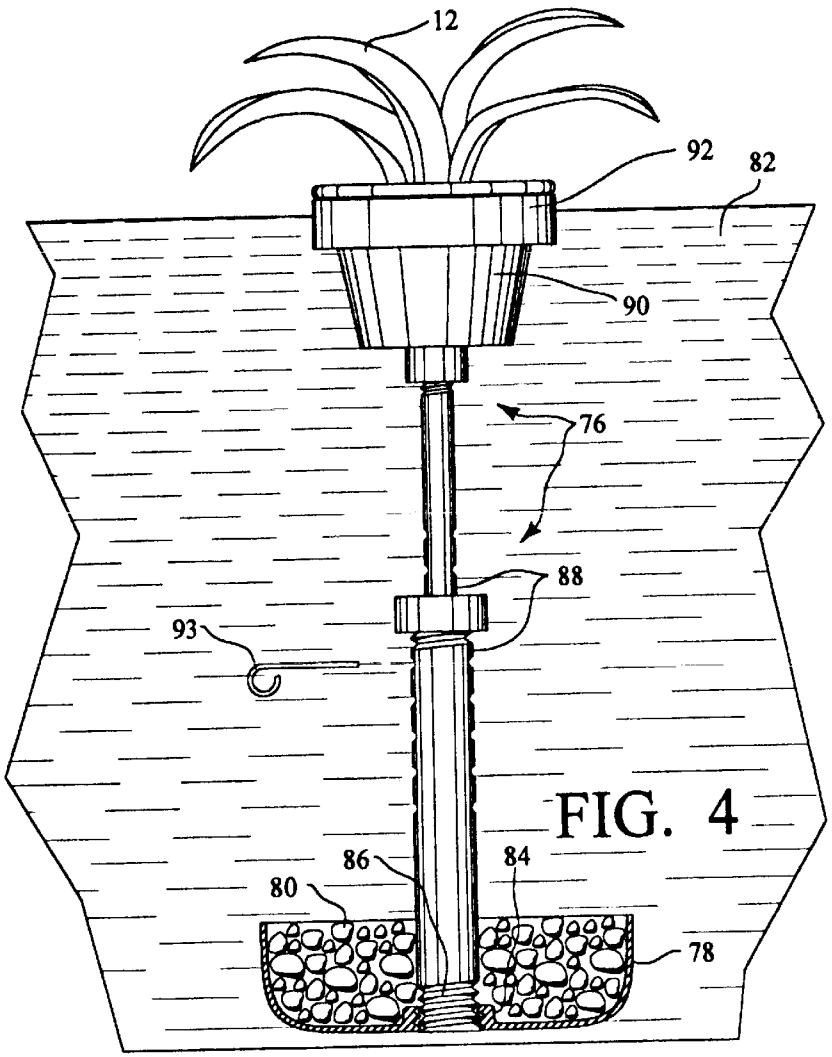
FIG. 4 shows an elevation view of an assembly for a floatable water plant receptacle disposed in a pond, pool, stream or tank of water, thus illustrating another important embodiment of my invention.

Referring now to FIG. 4, a water plant container assembly, generally denoted 76, is shown which is similar to the assembly 10 of the previous example except as to a base 78 and a base portion of a telescopically adjustable column 88. In this example, the base 78 is an open bowl shape filled with pebbles or rocks 80 to weigh it down in a pond 82. The base 78 contains an interiorly threaded central collar 84, into which a threaded lower end portion 86 of the column 88 is threaded. As in the previous example, an upper end portion of the column 88 is threaded into a collar on a base of a receptacle 90 and the receptacle floats on the surface of the pond 82 due to the use of a float collar 92. Alternatively, the height, of the receptacle 90 can be selected in increments and fixed by use of a pin 93 to fix the telescoping pipes of the column 88 relative to each other, the same as in the previous example.

Figure 6:
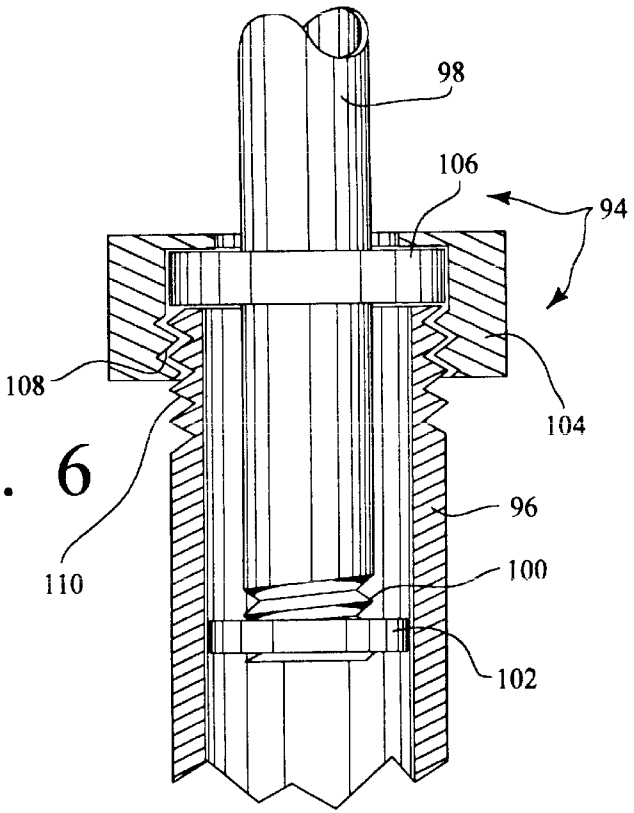
FIG. 6 shows a cross-sectional view of a fragment of an alternative telescopically adjustable column which may be used in place of a telescopically adjustable column shown in the prior drawing figures.

Referring now to FIG. 6, there in shown an alternative means for fixing the height of a telescoping column, generally designated 94, which may be used in place of the columns 38 or 88 of the previous examples without the need for a pin 64 and associated openings 62 and 66 such as shown in the previous example of FIGS. 1—3 and 5. The column 94 contains a first pipe 96 and a telescopically movable second pipe 98 projecting upwardly out of an upper open end of the first pipe. As in the example shown in FIGS. 1–3 and 5, a lower end portion of the second pipe 98 is exteriorly threaded, as at 100, and the threads contain a gasket 102 similar to the confinement ring 58. The column 94 also contains a cap 104, in the upper exterior of which is seated a compressible resilient, annularly shaped rubber or foam gasket 106. Immediately below the gasket 106, the interior sidewall of the cap 104 is threaded, as at 108, in conformity with exterior threading 110 on an upper end portion of the first pipe 96. The gasket 106 is sized so as to fit relatively loosely around the second pipe 98 until the cap 104 is threaded on to the first pipe 96 to the point wherein the gasket 106 is squeezed between an upper surface of the cap and an upper end of the first pipe, whereupon the gasket 106 is compressed by the interior walls of the cap 104 to form a tight friction fit around the second pipe 98. By loosening the cap 104, vertical compression of the gasket 106 is relieved, wherein the gasket relaxes from its tight fit around the second pipe 98 to allow the second pipe to be telescopically adjusted manually in the first pipe 96.

Although the present invention has been shown and described with respect to specific details of certain preferred and other important embodiments thereof, it is not intended that such details limit the scope of this patent other than as specifically set forth in the following claims, taking into consideration reasonable equivalents thereof.

I claim:

1. An adjustable water plant container assembly comprising a weightable base for stable disposition upon a floor of water filled containment means;

an elongate, vertically extending supporting column attached on a lower end portion thereof to said base, said column being telescopically adjustable in height above said base and including a first elongate, hollow, cylindrically shaped pipe having a lower end attached to said base; and a second elongate, hollow, cylindrically shaped pipe having an outside diameter less than an inside diameter of said first pipe, said second pipe being at least partially inserted slidably into an upper end portion of said first pipe, said receptacle being attached to an upper end of said second pipe;

a receptacle for a water plant or together vegetation being attached to an upper end of said supporting column;

an interiorly threaded cap having a circular central opening in an upper surface thereof, said second pipe having an upper end portion which is exteriorly threaded in conformity with the interior threading of said cap, said cap being disposed over and around said second pipe and removably attached to said first pipe, said second pipe containing exterior threading on a base portion; and a confinement ring being threadably mounted on the base portion of said second pipe and being sized to closely and slidably fit within and around the inner wall of said fist pipe.

2. The assembly of claim 1 wherein said base defines a closed hollow interior chamber and a closable access opening to said chamber for use in fitting said chamber with a mass of granulated material to enable said base to rest on said floor in water in a stable manner.

3. The assembly of claim 1 wherein said receptacle comprises a truncated cone shaped pot which is open on an upper end and includes a circular base plate on a lower end from which a collar containing interior threading projects downwardly, an upper end portion of said supporting column containing exterior threading conforming to and threadably joining the interior threading of the receptacle collar.

4. The assembly of claim 1 wherein said supporting column is removably attached to said base.

5. The assembly of claim 1 wherein said base forms an open bowl for filling with a quantity of rocks or pebbles, a lower end of said column being attached to a central collar centrally formed in and projecting upwardly from an inside bottom of said bowl.

6. The assembly of claim 2 wherein said base defines a hollow, cylindrically shaped shaft extending between and opening onto upper and lower surfaces of said base, at least a portion of said shaft containing interior threading, a base portion of said supporting column being exteriorly threaded in conformity with the interior threading in said shaft, said base portion being removably disposed in and threadably engaging the threading of said shaft.

7. The assembly of claim 6 wherein said chamber annularly extends about said shaft.

8. The assembly of claim 1, further comprising a compressible, resilient gasket being tightly disposed in an upper interior end portion of said cap and having a diameter sized to fit closely against an interior sidewall of said cap, said gasket also defining a circular central hole therethrough through which said second pipe extends in a close but slidable relationship when said cap is loosely threaded upon said first pipe such that said gasket is in a relaxed, uncompressed state, said gasket is being adapted to tightly and non-slidably grasp said second pipe when said cap is tightly threaded ton said pipe such that said gasket is placed in a compressed state.

* * * * *